US006405000B1

(12) United States Patent
Nakaya

(10) Patent No.: US 6,405,000 B1
(45) Date of Patent: Jun. 11, 2002

(54) IMAGE FORMING APPARATUS AND STARTING-UP METHOD

(75) Inventor: Masahide Nakaya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/561,973

(22) Filed: May 1, 2000

(30) Foreign Application Priority Data

May 6, 1999 (JP) ..... 11-126097

(51) Int. Cl.[7] ..... G03G 15/20
(52) U.S. Cl. ..... 399/67; 219/216; 399/88
(58) Field of Search ..... 399/33, 37, 67, 399/69, 88, 335; 219/216

(56) References Cited

U.S. PATENT DOCUMENTS

| | | | | | |
|---|---|---|---|---|---|
| 5,300,996 | A | | 4/1994 | Yokoyama et al. | 219/216 X |
| 5,426,495 | A | | 6/1995 | Sawamura et al. | 219/216 X |
| 5,594,540 | A | | 1/1997 | Higaya et al. | 399/326 |
| 5,627,628 | A | * | 5/1997 | Soda et al. | 399/69 X |
| 5,832,354 | A | | 11/1998 | Kouno et al. | 399/390 |
| RE36,124 | E | | 3/1999 | Yokoyama et al. | 399/330 |
| 5,915,147 | A | | 8/1999 | Kouno et al. | 399/69 |
| 5,942,882 | A | * | 8/1999 | Ohta | 399/69 X |
| 6,018,151 | A | * | 1/2000 | Hirst | 399/335 |
| 6,111,230 | A | * | 8/2000 | Cao et al. | 399/69 X |
| 6,169,871 | B1 | | 1/2001 | Higaya | 399/330 |
| 6,177,739 | B1 | * | 1/2001 | Matsudaira et al. | 399/88 X |
| 6,255,632 | B1 | | 7/2001 | Yokoyama et al. | 219/216 |

FOREIGN PATENT DOCUMENTS

| | | |
|---|---|---|
| JP | 9-218720 | 8/1997 |

* cited by examiner

*Primary Examiner*—Fred L Braun
(74) *Attorney, Agent, or Firm*—Oblon, Spivak, McClelland, Maier & Neustadt, P.C.

(57) ABSTRACT

An image forming apparatus and method for starting-up an image forming apparatus includes an image forming portion which forms a toner image on a recording sheet. A fixing portion includes a fixing roller having a built-in heating unit and fixes the toner image onto the recording sheet using the fixing roller. A starting-up portion starts up the image forming portion and the fixing portion. The starting-up portion first controls the power supplied to the fixing portion using a first level of power having a first maximum power level having a first maximum pulse width for heating the fixing roller when starting-up the image forming portion and the fixing portion. The starting-up portion controls the power supplied to the fixing portion during the starting-up of the image forming apparatus using a second level of power, having a maximum power level and a maximum pulse width smaller than the first level of power, for heating the fixing roller and supplies power to the image forming portion when a temperature of the fixing roller reaches a predetermined temperature.

17 Claims, 7 Drawing Sheets

IMAGE FORMING APPARATUS AND STARTING-UP METHOD

BACKGROUND OF THE INVENTION

1. Field of the Invention

The present invention generally relates to image forming apparatuses such as a copier, a printer, a facsimile machine and a method for starting-up such apparatuses. More specifically, the present invention relates to image forming apparatuses and a method for shortening the time required for the starting-up of such an apparatus, after a main switch of the apparatus is turned on.

2. Description of the Related Art

In an image forming apparatus such as a copier, a printer or the like, image forming operations are performed after a main switch of the apparatus is turned on by a user. The temperature of a fixing unit subsequently reaches a set temperature after waiting for an amount of time therebetween, (i.e. starting-up time). The starting-up time may reach more than 5 minutes. Therefore, the starting-up time of the apparatus is not convenient for users operating such an apparatus.

During this starting-up waiting time, preparation of units other than the fixing unit, for example, image forming units such as a developing unit, a photosensitive body, a charging unit, a transferring unit, a photosensitive body, a charging unit, a transferring unit, a main control unit, and so forth is performed for image formation. Other operations which may be performed during the starting-up waiting time may include confirmation of toner temperature, checking of a remaining amount of toner, preliminary rotation of the transferring unit and photosensitive body, initialization and abnormality checking of each unit by the main control unit, and so forth. However, the preparation of the other units is completed within a short time period in comparison to that of the fixing unit. In general, a preparation time of a fixing unit (i.e. a time required for the temperature of the fixing unit to reach a temperature, at which a fixing operation can be performed properly, from a normal temperature or room temperature) is in the range of 1 to 5 minutes. In a remarkably fast case, this time is in the range of 15 to 20 seconds. In contrast to this, the preparation time of units other than the fixing unit is completed within a time range of approximately 5 to 30 seconds.

In order to shorten the starting-up time, various proposals have been made. For example, the starting-up time may be shortened as a result of maintaining an input current to an image forming apparatus at not more than a predetermined value, and controlling a current flowing into a fixing unit. Alternatively, an upper limit of a power level consumed by a fixing unit may be controlled to vary between a starting-up occasion of an apparatus and an ordinary occasion thereof to shorten the starting-up time. Specifically, preparation instructions are given to the fixing unit and the image forming units other than the fixing unit from a body control unit at an apparatus starting up time, and the upper limit of the power supplied to the fixing unit is set to a large value only at the starting-up occasion.

According to the above-described procedures for shortening the starting-up time, the purpose can be achieved to some degree. However, the limit of an input current to an image forming apparatus prevents the starting-up time from being further shortened.

Further, at a starting up time, a power level is provided to the body control unit, and preparation of image forming units other than the fixing unit is performed at the same time as preparation of the fixing unit. Therefore, it is required to maintain power at the level in which the preparation of the image forming units other than the fixing unit is completed, even though the preparation of the image forming units other than the fixing unit is completed. Thus, power is uselessly consumed until preparation of the fixing unit is completed.

Further, in the related art, in order to shorten the starting-up time of a fixing unit, preparatory heating is conducted such that power is supplied to a fixing heater even during a standby condition. Thereby, it is possible to perform image formation without requiring any waiting time. However, when the frequency of times of image formation is low, power is needlessly consumed for the preparatory heating.

SUMMARY OF THE INVENTION

An object of the present invention is to solve the above-mentioned problems occurring in the prior art, and to provide an image forming apparatus in which a fixing unit is started up rapidly.

Further, another object of the present invention is to provide an image forming apparatus which can be started up rapidly and consumes less power during a standby condition.

An image forming apparatus according to the present invention comprises:

a power supply switch for an apparatus body;

a first power supply unit to which AC power is supplied as a result of the power supply switch being turned on;

a second power supply unit to which AC power is supplied;

a first control unit which is supplied power through the first power supply unit and performs control such that the apparatus operates in a power saving mode;

a canceling device for generating a power-saving-mode-canceling signal to be input the first control unit;

a second control unit which is supplied power through the second power supply unit and performs control such that power is supplied to an image forming arrangement provided for performing an image forming process and the image forming arrangement is started up, when a predetermined condition is satisfied after the power-saving-canceling signal is generated;

a fixing unit which is supplied AC power through a switch device, has a fixing roller and fixes a toner image, formed on a recording sheet by the image forming arrangement using the fixing roller; and a fixing-unit power changing arrangement for varying a level of power used by the fixing unit between a first predetermined fixing-unit power level and a second predetermined fixing-unit power level, the second predetermined fixing-unit power level being smaller than the first predetermined fixing-unit power level, wherein:

the fixing unit is started up as a result of the switch device being turned on, which in turn is a result of the canceling device being turned on;

a power control signal for changing the level of power used by the fixing-unit power changing arrangement is generated within the fixing unit;

the fixing-unit power changing arrangement changes the level of power used by the fixing unit based on the power control signal so that, when the fixing unit is to be started up, the first predetermined fixing-unit power level is a level of power used by the fixing unit until a temperature of the fixing roller reaches a predetermined temperature, and the second predetermined fixing-unit power level is a level of power used by the fixing unit after the temperature of the fixing roller reaches a predetermined temperature, this condition being the predetermined condition.

Thereby, as a result of reducing a power level used by the arrangement other than the fixing unit and increasing a power level used by the fixing unit for heating the fixing roller at a time of starting up, it is possible to shorten the overall starting up time.

The fixing-unit power changing arrangement may change the level of power used by the fixing unit based on the power control signal generated inside the fixing unit or another power control signal generated by the first control unit.

When the power supply to the fixing unit is interrupted by some problem, such as a cover of the apparatus body being opened after the image forming apparatus moves from a starting-up mode to a printing mode, the fixing unit cannot generate the power control signal inside thereof, even when the problem is corrected and power to the fixing unit is restored. At such a time, the first control unit generates the power control signal so that the image forming apparatus will re-enter the same mode as before the power supply interruption.

The image forming apparatus may further comprise a cover-opening/closing detecting device which detects that a cover of the apparatus body is opened/closed, wherein the switch device is turned off/turned on in response to the cover being opened/closed as detected by the cover-opening/closing detecting device.

Thereby, it is possible to completely stop supplying electricity to the fixing unit when the cover is opened. Thereby, it is possible to avoid a danger such as user receiving an electric shock.

When the cover is closed, a maximum level of power used by the fixing unit may be set and the switch device may be turned on.

Specifically, by first determining whether the power control signal is generated, and whether the level of power used by the fixing unit is set to the maximum level when the power control signal is not generated, but the level of power used by the fixing unit is set smaller than the maximum level when the power control signal is generated. Thereby, it is possible to restart heating of the fixing roller with a maximum level of power which is the same as that used before the cover is opened and closed.

Other objects and further features of the present invention will become more apparent from the following detailed description when read in conjunction with the accompanying drawings.

DETAILED DESCRIPTION OF THE PREFERRED EMBODIMENTS

Embodiments of the present invention will now be described based on drawings.

Figure 1:
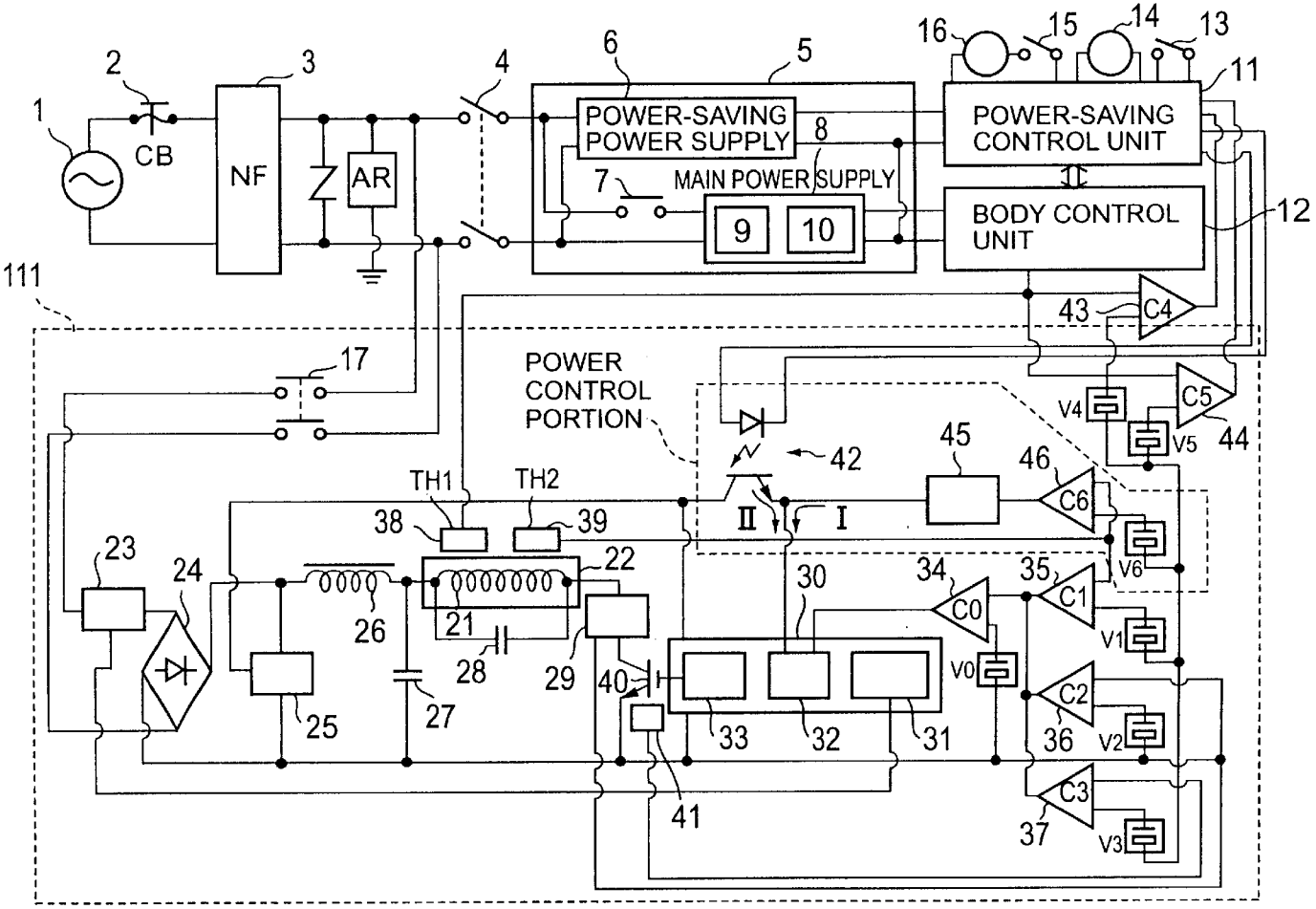
FIG. 1 is a block diagram showing a fixing unit, a power supply unit and surrounding image forming apparatus in each of first and second embodiments of the present invention.

FIG. 1 shows a block diagram showing a portion of an image forming apparatus in each of the first and second preferred embodiments of the present invention including a power supply unit and a fixing unit.

Figure 9:
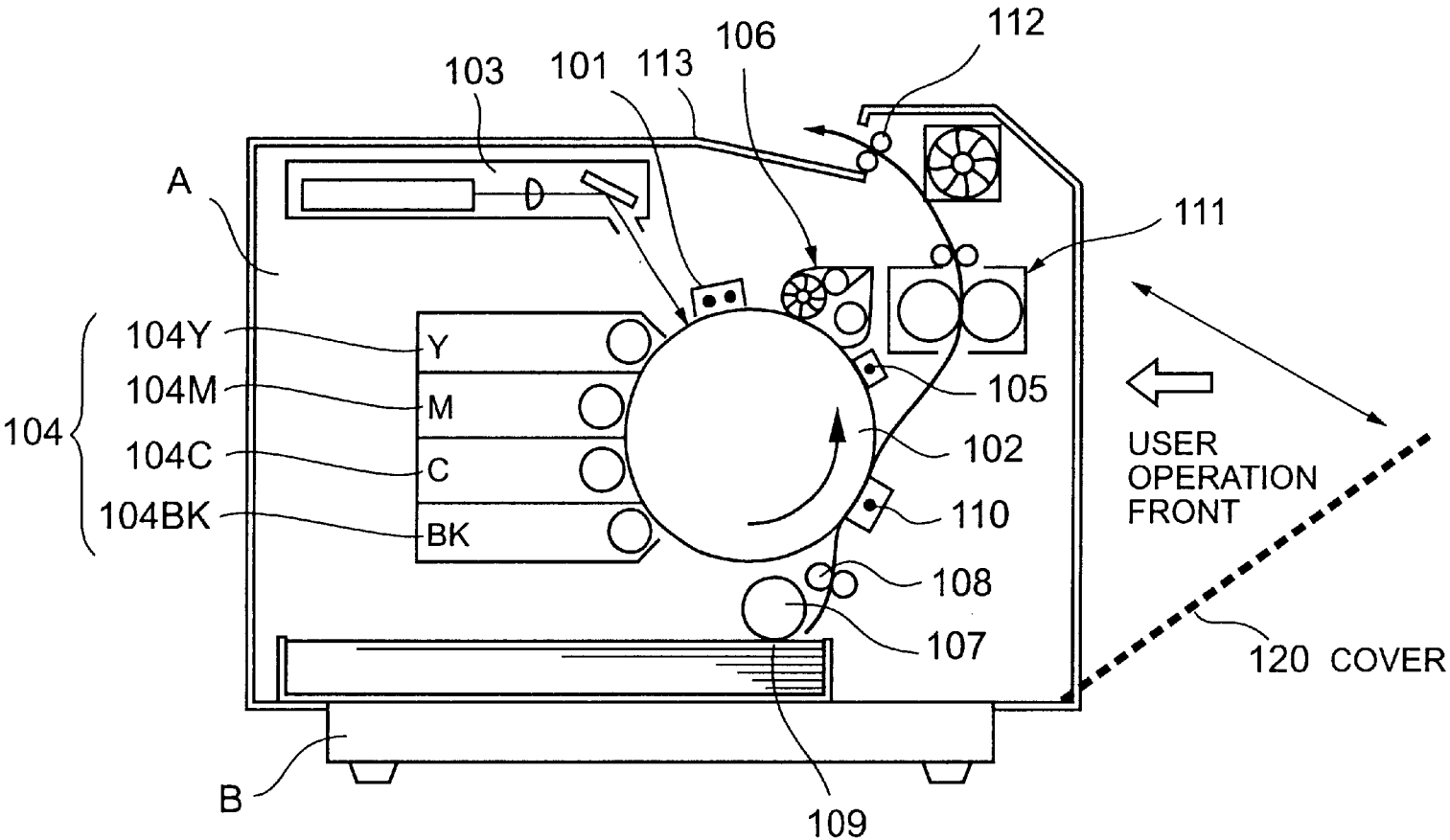
FIG. 9 shows a side elevational sectional view of the above-mentioned image forming apparatus.

FIG. 9 illustrates an arrangement of a laser printer which is the image forming apparatus in each of the first and second embodiments of the present invention.

In the laser printer, first, a charger 101 charges a photosensitive body 102 uniformly. Then, an optical writing unit 103 scans and exposes the photosensitive body 102 in accordance with an image signal for black (BK) and forms a negative electrostatic latent image thereon. That is, a surface electric potential on the photosensitive body 102 is decreased for an image portion as a result of being exposed. The thus-formed electrostatic latent image is developed by a developing unit 104BK (containing a black toner). Thus, a toner image of black (BK) is formed on the photosensitive body 102. At this time, conditions of other developing units 104Y, 104M and 104C other than the developing unit 104BK are controlled so that no toner is used therefrom. Then, an electricity-removal charger 105 charges the photosensitive body 102 so as to remove the electricity of the black electrostatic latent image on the photosensitive body 102. At this time, a cleaning unit 106 is at a distance away from the photosensitive body 102. Then, in the same way as that in which the black toner image is formed, processes of charging, exposure, development and electricity removal are repeated. Thus, toner images of yellow, magenta and cyan are formed as overlays on the photosensitive body 102. After all the toner images are formed, a recording paper sheet 109, which is previously conveyed and supplied by a paper supply roller 107 and is in a standby condition in a registering roller 108, is conveyed in appropriate timing with respect to a rotational position of the photosensitive body 102, and, the toner images on the photosensitive body 102 are electrostatically transferred to the recording paper sheet 109 by a transferring charger 110. Then, the toner images on the recording paper sheet 109 are heated and fixed onto the recording paper sheet 109 by a fixing unit 111. The recording paper sheet 109 is then ejected to a paper ejection portion 113 by an ejecting roller 112. The toner remaining on the photosensitive body 102 is removed by the cleaning unit 106 as a result of the cleaning unit 106 being pushed on to the photosensitive body 102. Thus, one cycle of color image formation is completed.

In the image forming apparatus (laser printer), power supplied to the apparatus is effectively used to provide three modes, i.e., a standby mode (power saving mode), a starting-up mode, and a printing mode for the purpose of reducing power consumed during a standby condition time and shortening a starting-up time required for reaching, from a standby condition, a condition in which image formation can be performed properly.

Specifically, the starting-up mode is a mode in which both the fixing unit 111 and image forming units, other than the fixing unit 111, such as the developing unit 104, photosensitive body 102, charging unit 101, transferring unit 110, a main control unit (not shown in the figure), and so forth are started up. Completion of the starting up of the fixing unit 111 occurs when the fixing unit 111 (actually, a fixing roller thereof) reaches a temperature at which the fixing unit 111 can heat and properly fix toner images onto a recording paper sheet 109. This temperature is called a reload temperature. However, in the present image forming apparatus, a target setting temperature at a fixing time is not the reload temperature, but a temperature higher than the reload temperature, in consideration of heat being removed by paper sheets successively caused to pass through the fixing unit 111. The temperature of the fixing unit 111 is controlled to achieve this target setting temperature. When the above-mentioned image forming units, other than the fixing unit, reach a condition wherein they are able to perform a series of image forming processes properly, starting up of the image forming units other than the fixing unit is completed. A condition of the image forming apparatus, from the beginning of the starting up to the completion thereof, such that a printing operation (the series of image forming processes) can be properly performed, is a condition of the starting-up mode. When both starting up of the fixing unit and starting up of the image forming units other than the fixing unit are completed, starting-up of the apparatus is completed, and the apparatus moves into the printing mode in which the apparatus can properly perform the printing operation. Then, when a request for printing is made by a user, the apparatus can perform the printing operation properly. In the first disclosed embodiment, when the temperature of the fixing unit 111 reaches the reload temperature, a main power supply of the image forming apparatus is started up (i.e. the upper limit of a level of power which can be used by the fixing unit 111 is changed to a lower level). It is noted that a time the main power supply is started up is not limited to the time the reload temperature is reached. A reason why the reload temperature is set as a temperature at which the main power supply is started up in the first embodiment is as follows: It is possible to simplify detection and management of temperatures; and by performing the changing at the reload temperature, it is possible for the temperature of the fixing unit 111 to reach from the reload temperature (185° C., in the present embodiment) to the target setting temperature (190° C., in the present embodiment) during a time required for completing starting up of the image forming units, other than the fixing unit, from the time at which the starting up thereof is begun. The time required for completing starting up of the image forming units, other than the fixing unit, from the time at which the starting up thereof is begun, is in the range of 5 to 30 seconds. This time is sufficient for the temperature of the fixing unit 111 to reach the target setting temperature from the reload temperature. Therefore, the temperature of the fixing unit 111 positively reaches the target setting temperature within this time. Thus, the temperature of the fixing unit 111 is prevented from decreasing to a temperature lower than the temperature at which the fixing unit can properly perform the fixing operation, during printing, and successive printing operations can be performed properly.

In FIG. 1, an AC power source 1, which is the image forming apparatus power source, is connected to a direct-current power-supply unit (PSU) 5 via a circuit breaker (CB) 2, a noise filter (NF) 3 and a main switch (SW1) 4. In the direct-current power supply unit 5, the power, thus supplied thereto, is further supplied to both a power-saving power supply (first power-supply unit) 6 and a main power supply (second power-supply unit) 8 via a main-power-supply relay 7. The main power supply 8 includes an active filter 9 and a multi-output converter (DC/DC) 10. The output of the power-saving power supply 6 is connected to a power-saving control unit (first control unit) 11 while the output of the main power supply 8 is connected to the body control unit (second control unit) 12. A power-saving canceling switch (canceling device) 13, for generating a power-saving mode (standby mode) canceling signal, is connected to the power-saving control unit 12. A coil 16 of a power relay 17 which acts as a switching device is connected to the power-saving control unit 11 via a door switch 15. The door switch 15 is arranged so as to be turned off and turned on when a cover 120, shown in FIG. 9, of the image-forming-apparatus body is opened and closed, respectively. The cover 120 is ordinarily closed to cover internal components/parts of the image forming apparatus, and is opened by a user when the user feeds recording paper sheets, removes paper sheet(s) jamming therein, or another abnormality occurs. The cover may also be opened when maintenance staff performs maintenance operations, for example. Also, a coil 14 of the main-power-supply relay 7 is connected to the power-saving control unit 11. The power-saving control unit 11 and body control unit 12 are connected so that signals/data can be transmitted/received therebetween.

Further, the AC power source 1 is also connected to the fixing unit (IH. INV) 111 via the power relay (switching portion) 17. In the present image forming apparatus, a fixing device using induction heating, and a plurality of temperature sensing units are provided for providing security.

In general, the fixing unit 111 includes a fixing roller 22 having a heating coil 21 built therein, a third power supply unit (PWM inverter) and temperature sensing units for sensing the temperature of the fixing roller 22. The third power supply unit drives the induction coil 21 acting as a fixing-roller heater. A pushing roller, which is pushed onto the fixing roller 22, and so forth are omitted from the figure. A recording paper sheet on which toner images are formed is inserted between the fixing roller and pushing roller, so that the toner images are heated and fixed onto the recording paper sheet.

The power supplied to the fixing unit 111 via the power relay 17 is supplied first to a direct-current power supply (DC/DC2) 25 via an AC detecting unit (ACS) 23 and a diode bridge (DB) 24. The power is also supplied to a resonation circuit consisting of the coil 21 for induction heating and a capacitor 28 via a filter consisting of a coil 26 and a capacitor 27. The power is further supplied to a switching device 40 via an eddy-current detecting unit (OCS) 29. The output of an IH control unit 30 is connected to this switching device 40.

The IH control unit 30 includes a timing circuit 31, a PWM circuit 32 and a driving circuit 33 which generate an ON signal for turning on the switching device 40. Power is supplied to the IH control unit 30 by the direct-current power supply 25. The output of the above-mentioned AC detecting unit 23 and a voltage applied to the switching device 40 are input to the timing circuit 31. Various output control signals are input to the PWM circuit 32 via a comparator 34.

The outputs of three comparators 35, 36 and 37 are input to the comparator 34. A second temperature detecting unit (inverter thermistor: TH2) 39 attached to the fixing roller 22 is connected to the first comparator (C1) 35. The eddy-current detecting unit 29 is connected to the second comparator (C2) 36. A temperature detecting unit (TS) 41 of the switching device 40 is connected to the third comparator 37. Reference voltages V1, V2 and V3 are connected to the other input terminals of these comparators, respectively.

A first temperature detecting unit (body thermistor) 38 attached to the fixing roller 22 is connected to the body control unit 12, and, is also connected to the power-saving control unit 11 via a fourth comparator (C4) 43 and a fifth comparator (C5) 44.

A sixth comparator (C6) 46, to which the output of the second temperature detecting unit 39 attached to the fixing roller 22 is input, is provided. The output of this comparator 46 is input to the PWM circuit 32 of the IH control unit 30 via a latch circuit 45.

Two routes of power control signals, i.e., a power control signal (II) input from the power-saving control unit 11 via a photo-coupler 42 and a power control signal (I) input from the sixth comparator 46 via the latch circuit 45 are input to the PWM circuit 32. These parts/components act as a power control portion (enclosed by a broken line in FIG. 1).

In the above-described arrangement, when the main switch 4 is turned on by a user, AC power from the AC power source 1 is supplied to the power-saving power supply (first power supply unit) 6 of the direct-current power supply 5, and the power-saving power supply 6 is started up. Then, the output of the power-saving power supply 6 is supplied to the power-saving control unit (first control unit) 11, and the power-saving control unit 11 is started up. Thereby, the image forming apparatus in the present embodiment enters the power-saving mode which is a standby condition.

Under the condition of the power-saving mode, when the power-saving canceling switch 13 connected to the power-saving control unit 11 is turned on by a user or other means and the power-saving canceling signal is input to the power-saving control unit 11, the power-saving control unit 11 cancels the power-saving mode so that the image forming apparatus moves into the starting-up mode.

In the starting-up mode, the power-saving control unit 11 turns on the power relay 17 so that AC power from the AC power source 1 is supplied to the fixing unit 111. Thereby, the AC power is supplied to the diode bridge 24 via the AC detecting unit 23. The diode bridge 24 rectifies the supplied AC power and outputs DC power, which is then input to the direct-current power supply 25. The direct-current power supply 25 then outputs low-voltage power to the IH control unit (third control unit) 30. Thereby, the IH control unit 30 is started up, control of the fixing-unit is started thereby, and the fixing unit 111 is thereby started up.

The IH control unit 30 generates the ON signal for alternately and repetitively (pulse signal) turning on and turning off the switching device 40 such that the output of the comparator 34 input to the PWM (Pulse Width Modulation: pulse duration modulation) circuit 32 becomes a predetermined value, and outputs the thus-generated ON signal (driving signal) to the switching device 40 from the driving circuit 33. Thereby, the switching device 40 starts a switching operation, i.e., alternately and repetitively turning on and turning off. Thereby, a driving current of the tens of kHz flows through the coil 21 for induction heating within the fixing roller 22. Thereby, the coil 21 generates magnetic flux passing through the fixing roller 22. Thereby, an eddy current flows through a conductor part of the fixing roller 22, and thereby, the fixing roller 22 generates Joule heat.

The temperature of the fixing roller 22 is detected by the second temperature detecting unit 39, and is compared with the reference voltage Vref1 by the first comparator 35. The difference therebetween, output by the comparator 35, is input to the PWM circuit 32 via the comparator 34, and the PWM circuit 32 generates the driving signal having the pulse width corresponding to the thus-input difference (by the well-known principle of pulse duration modulation or pulse width modulation). The thus-generated driving signal is output via the driving circuit 32 to the switching device 40. Thus, the IH control unit 30 controls the temperature of the fixing roller 22.

In the present image forming apparatus, the maximum pulse width of the driving signal generated by the PWM circuit 32 is changed between two stages corresponding to levels of power consumed by the fixing unit 111. A first maximum pulse width (wider or longer) of the driving signal is previously set such that a level of power input to the fixing unit 111 becomes the maximum allowable power level. Specifically, assuming that the maximum input power level of the apparatus is 1500 W, the first maximum pulse width of the driving signal is 1450 W (first power level) resulting from subtracting a level of power of 50 W, which is consumed by the power-saving power supply 6 and power-saving control unit 11, from this maximum input power level (1500 W), is consumed by the fixing unit 111. A second maximum pulse width (narrower or shorter) of the driving signal is previously set such that a level of power consumed by the fixing unit 111 is a second power level, smaller than the first power level at which power is consumed by the fixing unit 111 at a starting up time of the fixing unit, after the starting up of the fixing unit 111 is completed.

The respective reference voltages of the first, second and third comparators are previously set such that the output of the first comparator 35 is used for controlling the pulse width of the driving signal with priority to the outputs of the other comparators. The outputs of the second and third comparators 36 and 37 are used for controlling the pulse width of the driving signal only when abnormality occurs in the fixing unit 111.

By the above-described control of the temperature of the fixing roller 22, when the temperature of the fixing roller 22 reaches the reload temperature at which the fixing roller 22 can properly fix toner images onto a recording paper sheet, the sixth comparator 46 is turned on, and starts up the latch circuit 45. Thereby, the power control signal (I) is provided to the PWM circuit 32 from the latch circuit 45. Thereby, the pulse width of the driving signal generated by the PWM circuit 32 is controlled so that a level of power input to the fixing unit 111 is less than the second power level. Specifically, assuming that the maximum input power level of the apparatus is 1500 W, the second maximum pulse width of the driving signal is 900 W (second power level) resulting from subtracting a level of power of 600 W, which is consumed by the direct-current power supply 5, power-saving control unit 11, body control unit 12 and respective parts driven by these control units, from this maximum input power level (1500 W), which is consumed by the fixing unit 111.

The other comparators 36 and 37 are those for generating signals for protection at a time abnormality occurs in the fixing unit 111. The second comparator 36 is used for detecting over current of the switching device 40, and the third comparator 37 is used for detecting an abnormal temperature of the switching device 40. The reference voltage of each of these comparators is set such that the switching device 40 is turned off continuously so that no current flows through the induction coil 21 when the abnormality occurs.

The temperature of the fixing roller 22 is also detected by the first temperature detecting unit 38, and the output thereof is input to the power-saving control unit 11 and body control unit 12. Two routes of temperature information, i.e. the output of the comparator 43 and the output of the comparator 44, are input to the power-saving control unit 111 wherein the detection levels for these two routes of temperature information are set to different values. Specifically, the comparator 43 is used for detecting abnormality so that, when the temperature information input to the comparator 43 indicates a value exceeding a previously set value, it is determined that an abnormality occurs in the fixing unit 111. The power relay 17 is turned off so that supply of AC power to the fixing unit 111 is stopped. The comparator 44 is used for detecting that the temperature of the fixing roller has reached the reload temperature.

When the power-saving control unit 11 detects that the temperature of the fixing roller 22 has reached the reload temperature, the power-saving control unit 11 outputs the power control signal (II) via the photo-coupler 42 to the PWM circuit 32. When receiving this signal, the PWM circuit 32 generates the driving signal such that the maximum pulse width thereof becomes the second maximum pulse width in the same manner as that when receiving the power control signal (I).

Then, the power-saving unit 11 turns on the main-power-supply relay 7 so as to start up the main power supply (second power supply unit) 8. When a low-voltage power is supplied by the main power supply 8 to the body control unit 12, the body control unit 12 is started up. When the starting up is completed, the apparatus then moves into the printing mode in which the apparatus can perform the printing operation properly.

In the printing mode, the IH control unit 30 controls the pulse width of the driving signal output to the switching device 40 to be not more than the second maximum pulse width because the power control signal is input to the PWM circuit 32 of the IH control unit 30. Thus, the IH control unit 30 controls the temperature of the fixing roller 22 so that the temperature of the fixing roller 22 is maintained to have a predetermined value.

Operations concerning the door switch 15 will now be described.

The door switch 15 is provided for stopping the supply of power to the fixing unit 111, when the cover 120 of the image forming apparatus body is opened by a user, so as to avoid a danger such as the user getting an electric shock or the like. For this purpose, when the cover 120 is opened, the door switch 15 is turned off. Thereby, a current is prevented from flowing through the coil 16 of the power relay 17. As a result, the power relay 17 is turned off, and AC power supply to the fixing unit 111 is stopped. Thereby, heating of the fixing roller 22 is stopped.

When the cover 120 of the image forming apparatus is closed, the door switch 15 is turned on. Thereby, a current flow through the coil 16 of the power relay 17 restarts, AC power is again supplied to the fixing unit 11, and the fixing unit 111 is started up again. At this time, when the temperature of the fixing roller 22 is at the reload temperature, the power control signal (II) is input to the PWM circuit 32 via the photo-coupler 42. Thereby, heating of the fixing roller 22 is restarted in the condition in which the maximum pulse width of the driving signal output to the switching device 40 is controlled to the second maximum pulse width. However, at a time of starting up (when the temperature of the fixing roller 22 is lower than the reload temperature), heating of the fixing roller 22 is restarted in the condition in which the maximum pulse width of the driving signal output to the switching device 40 is controlled to the first maximum pulse width.

Figure 2:
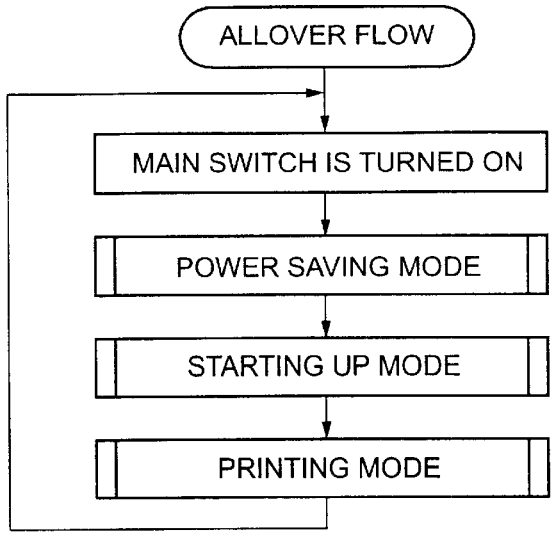
FIG. 2 is a flow chart showing the overall operations of the above-mentioned image forming apparatus.

FIG. 2 is a flow chart showing the overall operations of the image forming apparatus in the present image forming apparatus. As shown in the figure, when the main switch 4 is turned on by a user or by other means, the image forming apparatus enters the power-saving mode which is a standby condition. When the power-saving canceling switch 13 is turned on by a user or by other means in this condition, the image forming apparatus moves to the starting-up mode, and the fixing unit 111 is started up (the fixing roller 22 is heated). When starting up of the fixing unit 111 and starting up of the image forming units other than the fixing unit 111 are completed, the image forming apparatus moves to the printing mode. Then, when a user performs operation(s) on or by other means gives instructions to the image forming apparatus for causing the apparatus to perform the printing operation, the apparatus performs the printing operation. Then, after the printing operation is finished, a previously set condition(s) is satisfied. For example, during a predetermined time period starting when that printing operation is finished, neither of any operation(s) for causing the apparatus to perform the subsequent printing operation is performed by a user on the apparatus nor is any instruction for causing the apparatus to perform the subsequent printing operation given by other means to the apparatus. The image forming apparatus returns to the power-saving mode and enters the standby condition.

Figure 3:
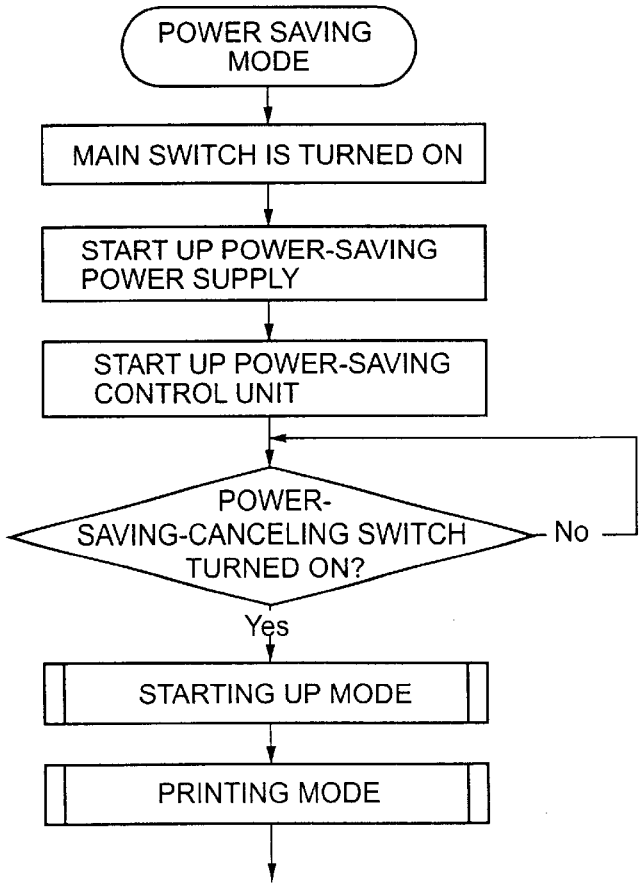
FIG. 3 is a flow chart of a power saving mode of operation of the above-mentioned image forming apparatus.

FIG. 3 is a flow chart of the power-saving mode of operation.

As shown in the figure, when the main switch 4 is turned on by a user or by other means, the power-saving power supply 6 is started up, and the power-saving control unit 11 is started up by the output thereof. Thereby, the image forming apparatus enters the power-saving mode, enters the standby condition and is maintained there until the power-saving canceling switch 13 is turned on by a user or a signal (that is, a signal from a host machine, a signal by FAX call incoming, or the like) for causing the image forming apparatus to perform the printing operation or copying operation. When the power-saving canceling switch 13 is turned on, the power-saving mode is canceled, and the image forming apparatus moves to the starting-up mode. When starting up of the fixing unit 111 and starting up of the image forming units other than the fixing unit 111 are completed, the image forming apparatus moves to the printing mode.

Figure 4:
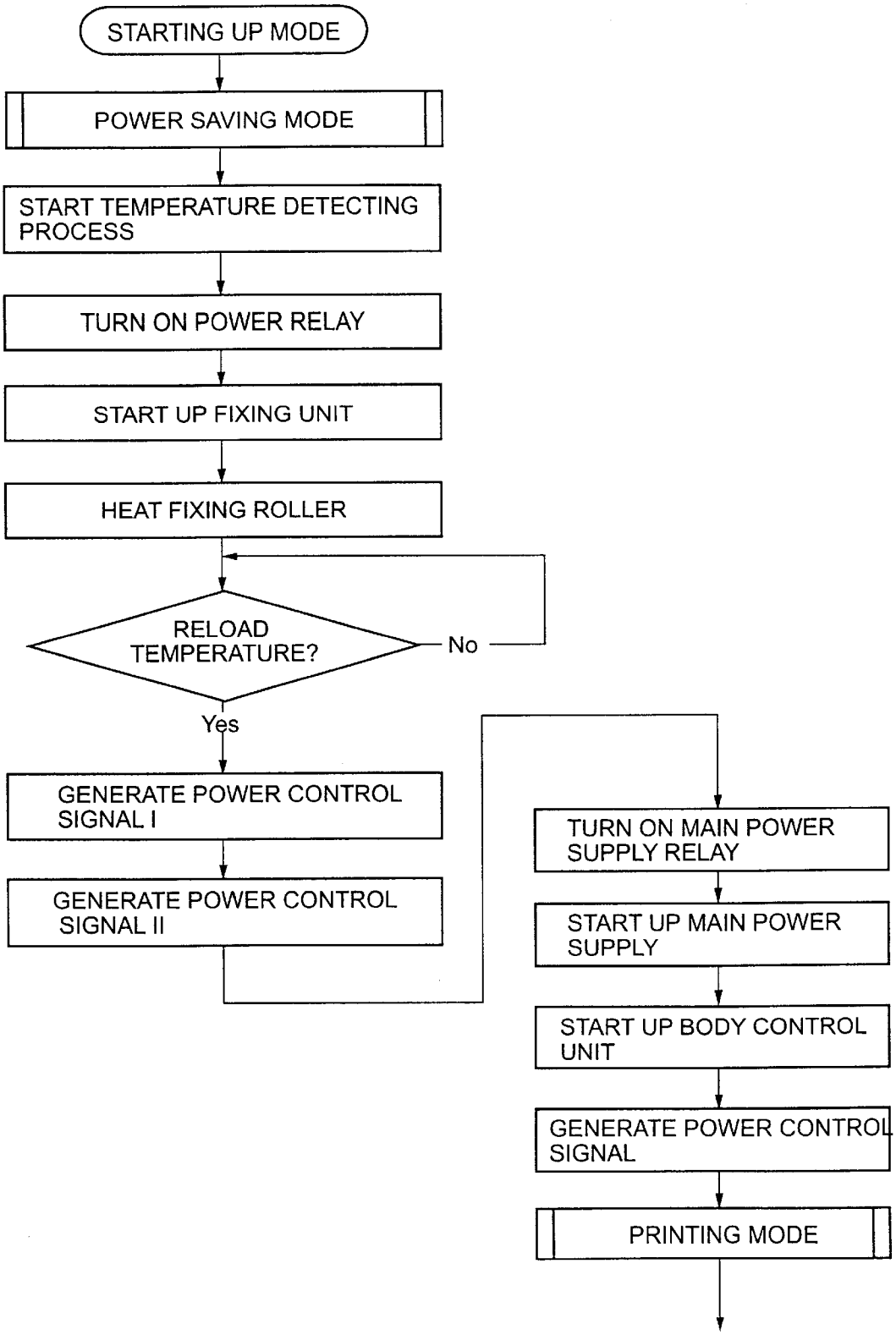
FIG. 4 is a flow chart of a starting-up mode of operation of the above-mentioned image forming apparatus.

FIG. 4 is a flow chart of the starting-up mode of operation.

As shown in the figure, when the image forming apparatus moves from the power-saving mode to the starting-up mode, the power-saving control unit 11 starts up a temperature detecting process (FIG. 5) which is an interrupt process. This process is performed until the main switch 4 is turned off, after the starting up. After the temperature detecting process is started, when the temperature of the fixing roller 22 is normal, the power-saving control unit 11 turns on the power relay 17. Thereby, the fixing unit 111 is started up, and the fixing roller 22 is heated. Then, when it is detected inside the fixing unit 111 that the temperature of the fixing roller 22 reaches the predetermined reload temperature (185° C. in the present embodiment), the power control signal (I) is generated and a level of power consumed by the fixing unit 111 is controlled. Then, the power-saving control unit 11 detects that the temperature of the fixing roller 22 reaches the predetermined reload temperature. Thereby, the power control signal (II) is output and starts up the main power supply 8. Thereby, the body control unit 12 is started up. The temperature control is performed in the fixing unit 111 with power, a level of which is controlled to be lower than that consumed at the time of starting up, and the image forming apparatus moves to the printing mode.

Figure 5:
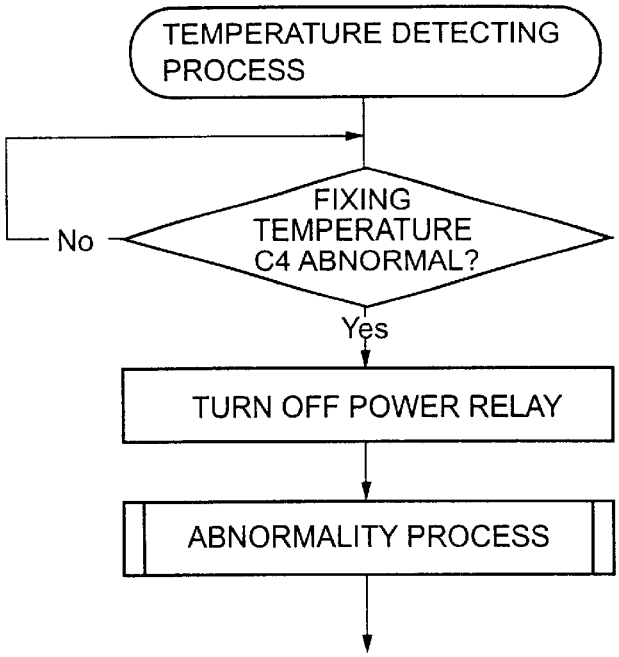
FIG. 5 is a flow chart of a temperature detecting process started when the above-mentioned image forming apparatus moves from the power saving mode to the starting-up mode.

FIG. 5 is a flow chart of the temperature detecting process started when the image forming apparatus moves from the power-saving mode to the starting-up mode.

As shown in the flow chart, in this process, abnormality of the temperature of the fixing roller 22 is monitored (detected). When an abnormality occurs (for example, when the temperature of the fixing roller 22 is equal to or higher than 220° C. ), the power-saving control unit 11 turns off the power relay 17 by an interrupt process, and stops supplying power to the fixing unit 111. Then, the power-saving control unit 11 transmits an abnormality detection signal to the body control unit 12, and the body control unit 12 performs an abnormality process (for example, indication of an abnormal state).

Figure 6:
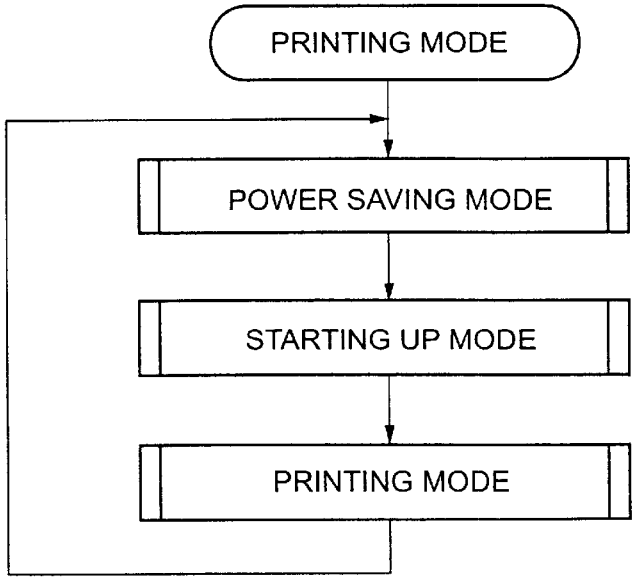
FIG. 6 is a flow chart of a printing mode of operation of the above-mentioned image forming apparatus.

FIG. 6 is a flow chart of the printing mode of operation.

As shown in the flow chart, when the image forming apparatus moves from the power-saving mode to the starting-up mode, and then moves from the starting-up mode to the printing mode when the starting up is completed, the image forming apparatus enters the condition in which the image forming apparatus can perform the printing operation properly. Then, the image forming apparatus performs the printing operation, performing copying or printing when it is requested. When the previously set condition(s) is satisfied after the printing operation is finished, the image forming apparatus moves to the power-saving mode.

Figure 8:
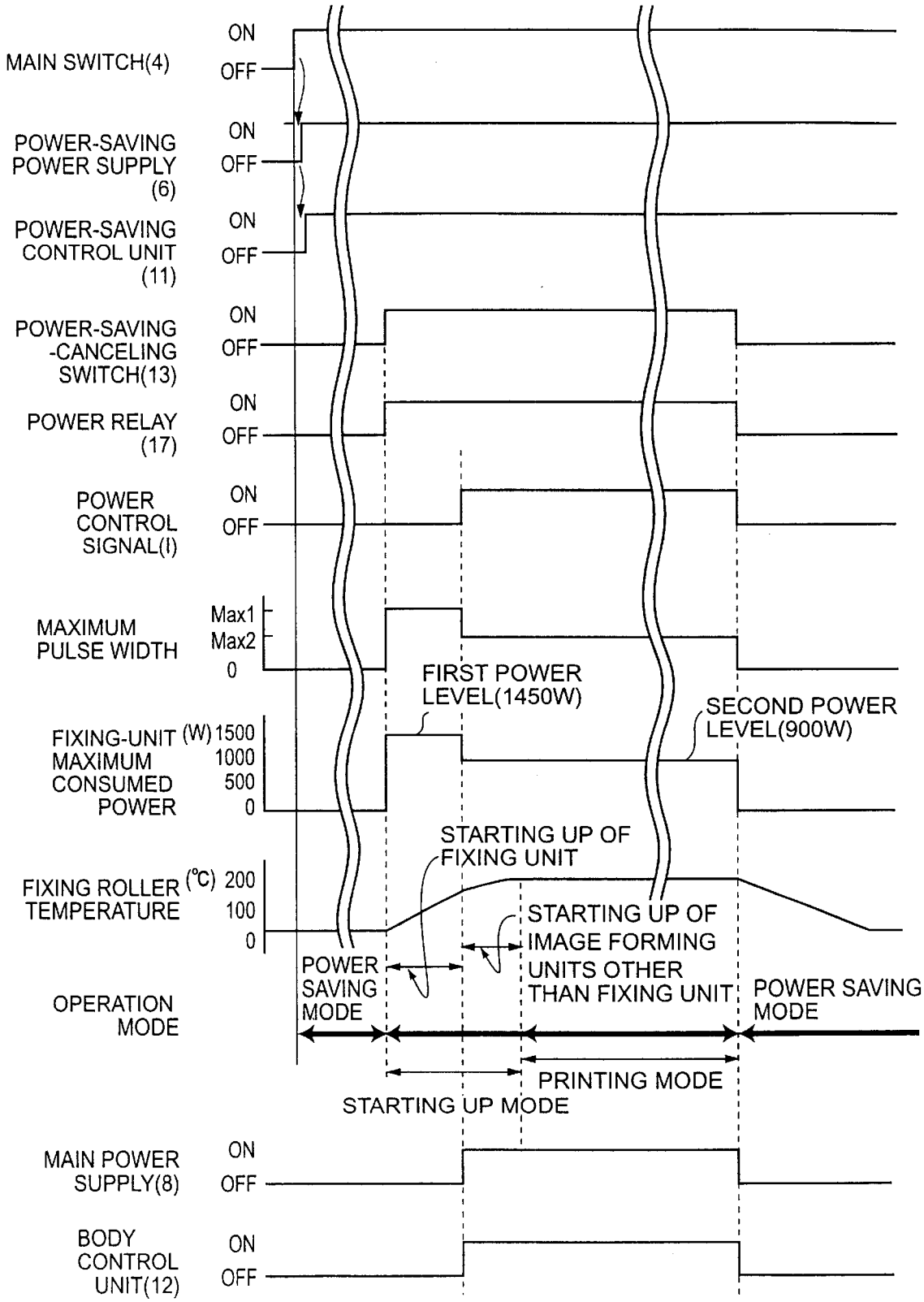
FIG. 8 is a timing chart showing operations/processes performed by the first embodiment of the above-mentioned image forming apparatus corresponding to those shown in FIGS. 2 through 6.

FIG. 8 is a time chart showing the operation flows of the image forming apparatus described above making reference to FIGS. 3 through 6.

Figure 7:
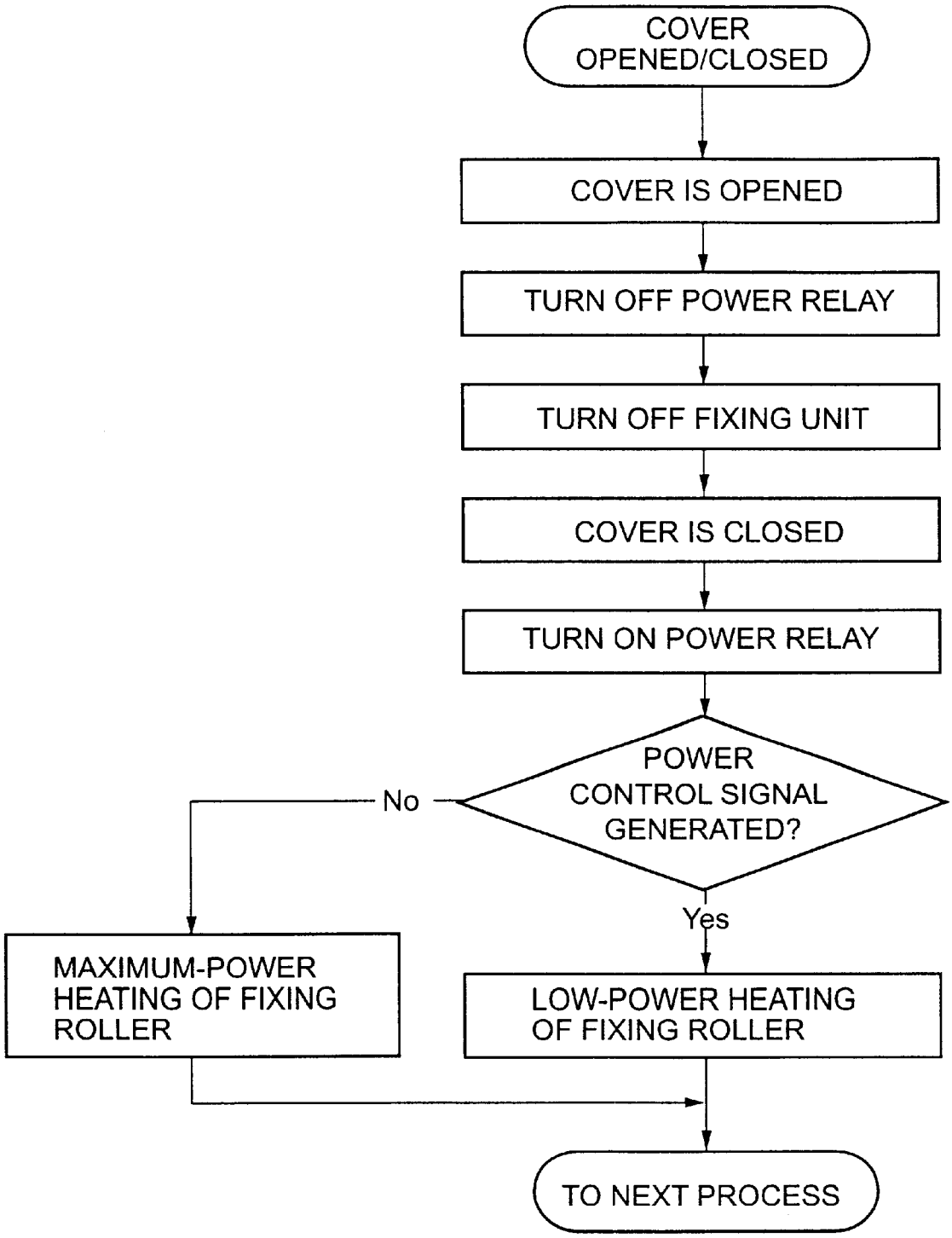
FIG. 7 is a flow chart showing a process performed, when a cover of an apparatus body is opened/closed, by the above-mentioned image forming apparatus.

FIG. 7 is a flow chart showing a process performed when the cover 120, shown in FIG. 9, is opened/closed.

As shown in the flow chart, when the cover 120 of the image forming apparatus is opened, the door switch 15 is turned off, and the power relay 17 is turned off. Thereby, power supply to the fixing unit 111 is stopped. Then, when the cover 120 of the image forming apparatus is closed, the door switch 15 is turned on, and the power relay 17 is turned on. At this time, when the power control signal is output by the power-saving control unit 11, the maximum pulse width of the driving signal of the switching device 40 is controlled. Thereby, heating of the fixing roller 22 is restarted with power, a level of which is lower than that at which power is consumed at the time of starting up in the fixing unit 111. However, when no power control signal is output by the power-saving control unit 11, heating of the fixing roller 22 is restarted in a condition in which the maximum level of power is supplied to the fixing unit 111.

Thus, in the starting-up mode, first, a level of power supplied to the fixing unit 111 can be increased because power consumed by the units other than the fixing unit is reduced because no power is being supplied to the main power supply 8. Thereby, the time required for starting up the fixing unit 111 can be shortened.

Thereby, it is possible to effectively use the limited power input to the image forming apparatus, and to provide the power-saving-type image forming apparatus which has the short starting up time required for reaching the condition, in which the apparatus can properly perform the printing operation, from the standby condition.

Further, the temperature of the fixing roller 22 is monitored both inside of the fixing unit 111 and by the power-saving control unit 11. When it is detected that the temperature of the fixing roller 22 has reached the reload temperature, the power control signal (I) is generated inside the fixing unit 111 and the power control signal (II) is generated by the power-saving control unit 11. When power supply to the fixing unit 111 is interrupted by some problem, such as the cover 120 being opened after the image forming apparatus moves from the starting-up mode to the printing mode and the maximum pulse width of the driving signal of the switching device 40 is controlled to the second maximum pulse width, the fixing unit 111 cannot generate the power control signal (I) inside thereof when the power supply to the fixing unit 111 is restarted as a result of the above-mentioned problem being resolved. At such a time, the power-saving control unit 11 generates the power control signal (II) so that the image forming apparatus will enter the same mode as that utilized by the image information apparatus before the stoppage of power supply to the fixing unit 111, as mentioned above. However, it is also possible to omit the arrangement for generating the power control signal (II) so that control of a level of power consumed by the fixing unit 111 to the second power level is performed only by the power control signal (I) generated inside thereof.

The power relay 17 for supplying power to the fixing unit 111 is turned off when the door switch 15 is turned off, as mentioned above. Thereby, it is possible to completely stop providing electricity to the fixing unit 111, and thus to avoid a danger, such as an electric shock to a user.

When the cover 120 is closed after being opened, it is determined whether or not the power control signal is output. Then, depending on the result of the determination, a level of power supplied to the fixing unit 111 is changed between the second power level (lower than the maximum power level) and the first power level (maximum power level), as mentioned above. Thereby, it is possible to restart heating of the fixing roller 22 in the same condition as that in which the fixing roller 22 is heated before the cover 120 is opened and closed.

A second embodiment of the present invention will now be described.

A difference between the second embodiment and the above-described first embodiment is that a temperature at which the main power supply 8 is started up in the first embodiment is a temperature lower than the reload temperature in the second embodiment. That is, the level of power consumed by the fixing unit 111 is changed.

This embodiment is devised for efficiently using a time required for starting up the image forming units other than the fixing unit 111 and a power supplied to the fixing unit 111.

The time required for starting up the image forming units other than the fixing unit 111 is different between a case where the starting up operation is performed initially when the main switch 4 of the image forming apparatus is turned on and a case where the starting up operation is performed after the printing operation is performed once, and then the power-saving mode is entered. Specifically, immediately after the main switch 4 is turned on, the starting up of the image forming units other than the fixing unit 111 includes checking of the current status, checking as to whether an abnormality is present, and setting of the environment. However, once the printing operation is performed, the starting up of the image forming units other than the fixing unit 111 only includes checking for an abnormality or includes simplified ones of the respective preparations. Accordingly, the time required in the latter case is shorter. In the present embodiment, the time required for the former case (i.e. the starting up of the image forming units other than the fixing unit 111 immediately after the main switch 4 is turned on) is on the order of 20 seconds, and the time required for the latter case (i.e. the starting up of the image forming units other than the fixing unit 111 after the printing operation is performed once) is on the order of 5 seconds.

The temperature of the fixing roller 22 at which the level of power consumed by the fixing unit 111 is changed from the first power level (larger) to the second power level (smaller) is set to 100° C. when the starting up of the image forming units other than the fixing unit 111 is performed immediately after the main switch 4 is turned on. However, the temperature of the fixing roller 22 at which the power consumed by the fixing unit 111 is changed from the first power level (larger) to the second power level (smaller) is set to 160° C. when the starting up of the image forming units other than the fixing unit 111 is performed after the printing operation is performed once, and the power-saving mode is entered. These temperatures are calculated using temperature gradients obtained from experiments. Specifically, the time required for the temperature of the fixing roller 22 to increase from 100° C. to 185° C. by the second power level (900 W) is on the order of 20 seconds, and the time required for the temperature of the fixing roller 22 to increase from 160° C. to 185° C. by the second power level (900 W) is on the order of 5 seconds. By setting the temperatures at which the level of power consumed by the fixing unit 111 is changed from the first power level (1450 W) to the second power level (900 W), as mentioned above, the time at which the starting up of the image forming units other than the fixing unit 111 is completed approximately coincides with the time at which the temperature of the fixing roller 22 reaches the reload temperature (185° C. ) so that the fixing unit 111 can fix toner images onto a recording paper sheet properly. Thus, starting up of the fixing unit 111 is completed at approximately the same time as that at which starting up of the image forming units other than the fixing unit 111 is completed. As a result, the time required for the overall starting up of the image forming apparatus is shortened. If the temperatures at which the level of power consumed by the fixing unit 111 is changed from the first power level (1450 W) to the second power level (900 W) are set to values higher than those mentioned above, the temperature of the fixing roller 22 of the fixing unit 111 reaches the reload temperature before the image forming units other than the fixing units 111 are started up. As a result, the time required for the overall starting up of the image forming apparatus is lengthened. If the temperatures at which the level of power consumed by the fixing unit 111 is changed from the first power level (1450 W) to the second power level (900 W) are set to values lower than those mentioned above, the image forming units other than the fixing units 111 are started up before the temperature of the fixing roller 22 of the fixing unit 111 reaches the reload temperature. As a result, the time required for the overall starting up of the image forming apparatus is lengthened.

Thus, the present invention has been described by the first and second preferred embodiments thereof. However, the present invention is not limited to those embodiments. For example, the fixing unit is not limited to that using induction heating, and the present invention can be applied to an image forming apparatus using a halogen heater in the fixing unit thereof, or to an image forming apparatus using a resistance (surface)-heating-type fixing unit.

Each of the above-described embodiments includes the fixing unit 111 using the fixing roller 22 heated by induction heating. Such a fixing unit (device) using induction heating is a well-known art as disclosed by the U.S. Pat. No. 5,832,354 (Kouno et al.).

In each of the embodiments, the PWM inverter is used as the power supply unit. Thereby, changing of the power consumed by the fixing unit can be easily performed (without proving separate heating units). As a fixing unit using a PWM inverter, an induction-heating-type fixing unit is common, as shown in each embodiment. However, as the present inventor proposed in Japanese Laid-Open Patent Application No. 9-218720, a halogen heater can be used in a fixing unit which performs fixing using a PWM inverter. Further, although an arrangement becomes complicated in comparison to the above-mentioned arrangements, it is also possible to prepare two halogen heaters (for example, a heater A and a heater B) with power being supplied to both the heaters A and B when the level of power consumed by the fixing unit is the first power level, but when the level of power consumed by the fixing unit is the second power level, power is being supplied only to the heater B.

Further, by providing initial settings such that the power-saving canceling switch 13 is turned on when the main switch 4 is turned on, power is supplied to the fixing unit 111 at approximately the same time as the main switch 4 is turned on. Thereby, it is possible to combine the main switch turning on operation and the power saving canceling operation into one operation. Also in this case, it is preferable that, after the printing operation is finished (i.e. immediately after the printing operation is finished or when, after the printing operation is finished, neither user's operation nor instructions by other means for the subsequent printing operation is performed during a predetermined time period), or when after the starting up operation is completed, neither user's operation nor instructions by other means for the subsequent printing operation is performed during a predetermined time period after the completion of the starting up operation, the image forming apparatus moves to the power-saving mode (i.e. the power-saving canceling switch 13 is turned off) automatically.

As an example, the values of the first power level (1450 W) and second power level (900 W) set by the first and second maximum pulse widths of the driving signal of the switching device 40, respectively. Appropriate values suited to a particular apparatus may be set.

Further, the present invention is not limited to the above-described embodiments, and variations and modifications may be made without departing from the scope of the present invention.

The present application is based on Japanese priority application No. 11-126097, filed on May 6, 1999, the entire contents of which are hereby incorporated by reference.

What is claimed is:

1. An image forming apparatus comprising:

an image forming portion which forms a toner image on a recording sheet;

a fixing portion which includes a fixing roller and fixes the toner image onto the recording sheet using said fixing roller; and wherein, when starting up said image forming portion and said fixing portion, said starting-up portion and first controls said fixing portion so that a first level of power is used for heating said fixing roller, and, then, when a temperature of said fixing roller reaches a predetermined temperature, said starting-up portion controls said fixing portion so that a second level of power, smaller than said first level of power, is used for heating said fixing roller and supplies power to said image forming portion.

2. An image forming apparatus according to claim 1, wherein said predetermined temperature is lower than a target set temperature at a time of fixing the toner image onto a recording sheet in said fixing portion.

3. An image forming apparatus according to claim 1, wherein starting up said image forming portion and said fixing portion comprises starting up said image forming portion and said fixing portion to enable said fixing portion to perform an image forming operation.

4. An image forming apparatus according to claim 1, wherein said starting-up portion further controls said fixing portion to control power-consumption distribution for said fixing portion and said image forming portion to control a maximum power consumption of the entirety of said image forming apparatus when said image forming apparatus is started up.

5. An image forming apparatus comprising:

image forming means for forming a toner image on a recording sheet;

fixing means, including a fixing roller, for fixing the toner image onto the recording sheet using said fixing roller; and starting-up means for starting up said image forming means and said fixing means, wherein, when starting up said image forming means and said fixing means, said starting-up means first controls said fixing means so that a first level of power is used for heating said fixing roller, and, then, when a temperature of said fixing roller reaches a predetermined temperature, said starting-up means controls said fixing means so that a second level of power, smaller than said first level of power, is used for heating said fixing roller and supplies power to said image forming means.

6. An image forming apparatus according to claim 5, wherein said predetermined temperature is lower than a target set temperature at a time of fixing the toner image onto a recording sheet in said fixing means.

7. An image forming apparatus according to claim 5, wherein starting up said image forming means and said fixing means comprises starting up said image forming means and said fixing means to enable said fixing means to perform an image forming operation.

8. An image forming apparatus according to claim 5, wherein said starting-up further controls said fixing means to control power-consumption distribution for said fixing means and said image forming means to control a maximum power consumption of the entirety of said image forming apparatus when said image forming apparatus is started up.

9. An image forming apparatus comprising:

a power supply switch for an apparatus body;

a first power supply unit to which AC power is supplied as a result of said power supply switch being turned on;

a second power supply unit to which AC power is supplied;

a first control unit which is supplied power through said first power supply unit and performs control such that said apparatus operates in a power saving mode;

a canceling device for generating a saving-mode-canceling signal to be input to said first control unit;

a second control unit which is supplied power through said second power supply unit and performs control such that power is supplied to an image forming arrangement provided for performing an image forming process and said image forming arrangement is started up, when a predetermined condition is satisfied after the power-saving-canceling signal is generated;

a fixing unit which is supplied AC power through a switch device, has a fixing roller and fixes a toner image, formed on a recording sheet by said image forming arrangement using said fixing roller; and a fixing-unit-power changing arrangement for changing a level of power used by said fixing unit between a first predetermined fixing-unit power level and a second predetermined fixing-unit power level, the second predetermined fixing-unit power level being smaller than the first predetermined fixing-unit power level, wherein:

said fixing unit is started up as a result of said switch device being turned on as a result of said canceling device being turned on;

a power control signal for changing the level of power used by said fixing unit by said fixing-unit-power changing arrangement is generated inside said fixing unit; and said fixing-unit-power changing arrangement changes the level of power used by said fixing unit based on the power control signal so that, when said fixing unit is to be started up, the first predetermined fixing-unit power level of power is used by said fixing unit until a temperature of said fixing roller reaches a predetermined temperature, and the second predetermined fixing-unit power level of power is used by said fixing unit after the temperature of said fixing roller reaches said predetermined temperature, this condition being said predetermined condition.

10. The image forming apparatus as claimed in claim 9, wherein said fixing-unit-power changing arrangement changes the level of power used by said fixing unit based on said power control signal or another power control signal generated by said first control unit.

11. The image forming apparatus as claim 9 further comprising a cover-opening/closing detecting device which detects that a cover of the apparatus body is opened/closed, wherein said switch device is turned off/turned on in response to said cover being opened/closed detected by said cover-opening/closing detecting device.

12. The image forming apparatus as claimed in claim 11, wherein, when said cover is closed, a maximum level of power used by said fixing unit is set and said switch device is turned on.

13. The image forming apparatus as claimed in claim 9, wherein said predetermined temperature is set to be a temperature lower than a temperature at which said fixing roller can be used to fix a toner image onto a recording sheet properly, a time required for the temperature of said fixing roller to reach, from said predetermined temperature, said temperature at which said fixing roller can be used to fix a toner image onto a recording sheet properly being approximately equal to a time required for starting up said image forming arrangement so that said image forming arrangement can perform the image forming process properly.

14. A method of starting up of an image forming apparatus comprising an image forming portion for forming a toner image on a recording sheet and a fixing portion for fixing the toner image onto the recording sheet using a fixing roller, comprising the steps of:

a) controlling said fixing portion so that a first level of power is used for heating said fixing roller;

b) controlling said fixing portion so that a second level of power, smaller than said first level of power, is used for heating said fixing roller and supplying power to said image forming portion, when a temperature of said fixing roller reaches a predetermined temperature as a result of said fixing roller being heated by said step a.

15. A method of starting up of an image forming apparatus comprising an image forming portion for forming a toner image on a recording sheet and a fixing portion for fixing the toner image onto the recording sheet using a fixing roller, according to claim 14, wherein said predetermined temperature is lower than a target set temperature at a time of fixing the toner image onto a recording sheet in said fixing portion.

16. A method of starting up of an image forming apparatus comprising an image forming portion for forming a toner image on a recording sheet and a fixing portion for fixing the toner image onto the recording sheet using a fixing roller, according to claim 14, wherein starting up said image forming portion and said fixing portion comprises starting up said image forming portion and said fixing portion to enable said fixing portion to perform the image forming operation.

17. A method of starting up of an image forming apparatus comprising an image forming portion for forming a toner image on a recording sheet and a fixing portion for fixing the toner image onto the recording sheet using a fixing roller, according to claim 14, wherein said starting-up portion further controls said fixing portion to control power-consumption distribution for said fixing portion and said image forming portion to control a maximum power consumption of the entirety of said image forming apparatus from the time of image forming apparatus start up.

* * * * *